US011105029B2

(12) United States Patent
Chan

(10) Patent No.: US 11,105,029 B2
(45) Date of Patent: Aug. 31, 2021

(54) SEWING OR LOOPING DEVICE FOR CLOSING A TUBULAR KNITTED ARTICLE

(71) Applicant: DA KONG ENTERPRISE CO., LTD., Changhua County (TW)

(72) Inventor: Meng-Hsun Chan, Changhua (TW)

(73) Assignee: Da Kong Enterprise Co., Ltd., Changhua (TW)

( * ) Notice: Subject to any disclaimer, the term of this patent is extended or adjusted under 35 U.S.C. 154(b) by 180 days.

(21) Appl. No.: 16/542,011

(22) Filed: Aug. 15, 2019

(65) Prior Publication Data

US 2020/0308746 A1 Oct. 1, 2020

(30) Foreign Application Priority Data

Mar. 28, 2019 (TW) ..... 108110884

(51) Int. Cl.
*D05B 37/04* (2006.01)
*D05B 23/00* (2006.01)

(52) U.S. Cl.
CPC ..... *D05B 37/04* (2013.01); *D05B 23/007* (2013.01)

(58) Field of Classification Search
CPC ..... D04B 35/34; D04B 9/40; D05B 23/007; D05B 23/009; D05B 23/008; D05B 37/04; D05B 37/08; D05B 37/06; D05B 7/00
USPC ..... 112/122, 129; 66/148
See application file for complete search history.

(56) References Cited

U.S. PATENT DOCUMENTS 3,998,172 A * 12/1976 Marforio ..... D05B 65/00 112/293
4,875,423 A * 10/1989 Conti ..... D05B 93/00 112/438
5,487,281 A * 1/1996 Frullini ..... D04B 15/18 66/13
2011/0073028 A1* 3/2011 Lonati ..... D05B 23/007 112/129
2019/0226131 A1* 7/2019 Mustafa ..... D04B 35/34

FOREIGN PATENT DOCUMENTS

WO 2009/144049 A 12/2009

* cited by examiner

*Primary Examiner* — Alissa L Hoey
*Assistant Examiner* — Patrick J. Lynch
(74) *Attorney, Agent, or Firm* — Wang Law Firm, Inc.

(57) ABSTRACT

A sewing or looping device for closing a tubular knitted article includes a body, two needles, a yarn support, and a cutting unit; the body has two spaced bases, the two needles are pivotally connected to the first base, respectively, and pivoting movement paths of the two needles are orthogonal to each other, the yarn support has a first section adjustably disposed on one of the bases, and a second section extending along an axial direction. The cutting unit is pivotally connected to the base where the yarn support is located. A cutting direction of the cutting unit is parallel to the axial direction, and the sewing chain stitch is pulled to the cutting point by the hook member and cut thereat. The sewing chain stitch assumes a tensioned state when being pulled, which in turn allows the sewing chain stitch to be cut more reliably and easily.

5 Claims, 13 Drawing Sheets

SEWING OR LOOPING DEVICE FOR CLOSING A TUBULAR KNITTED ARTICLE

BACKGROUND

Field of the Invention

The present invention relates to a sewing or looping device for closing a tubular knitted article.

Related Prior Art

The international patent publication No WO2009/144049 discloses a conventional sewing or looping head, since the sewing chain stitch wound on the yarn support is taken out from the tip of the yarn support, the cutting element has to perform cutting at a position perpendicular to the sewing chain stitch. In order to set the cutting element at the position perpendicular to the sewing chain stitch, a cutting space is generally reserved on the machine body, which increases the size of the machine.

The present invention has arisen to mitigate and/or obviate the afore-described disadvantages.

SUMMARY

One objective of the present invention is to solve the problem that the machine body of the knitting machine has to be preserved with the space for the sewing or looping device, thereby reducing the volume of the knitting machine, and the chain stitch can surely be cut, thereby improving the efficiency of cutting.

To achieve the above objective, a sewing or looping device for closing a tubular knitted article provided by the invention comprises a body, two needles, a yarn support, and a cutting unit; a front side of the body has two bases spaced apart from each other, the two needles are pivotally connected to the two bases, respectively, and pivoting movement paths of the two needles are orthogonal to each other, the yarn support has a first section adjustably disposed on one of the bases, and a second section of the yarn support opposite the first section extends along an axial direction, the cutting unit being pivotally connected to the one of the bases where the yarn support is located, characterized in that: a cutting direction of the cutting unit is parallel to the axial direction of the yarn support, the cutting unit is selectively in a standby position and an active position with respect to the yarn support, when in the standby position, the cutting unit is located away from the second section of the yarn support, and when in the active position, the cutting unit is located close to the second section of the yarn support.

To achieve the above objective, a method of using the sewing or looping device for closing the tubular knitted article mentioned above, comprises the following steps:

a step of pulling: pulling, by the cutting unit, a sewing chain stitch to a cutting point which is located away from one end of the second section of the yarn support; and a step of cutting: cutting the sewing chain stitch at the cutting point.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
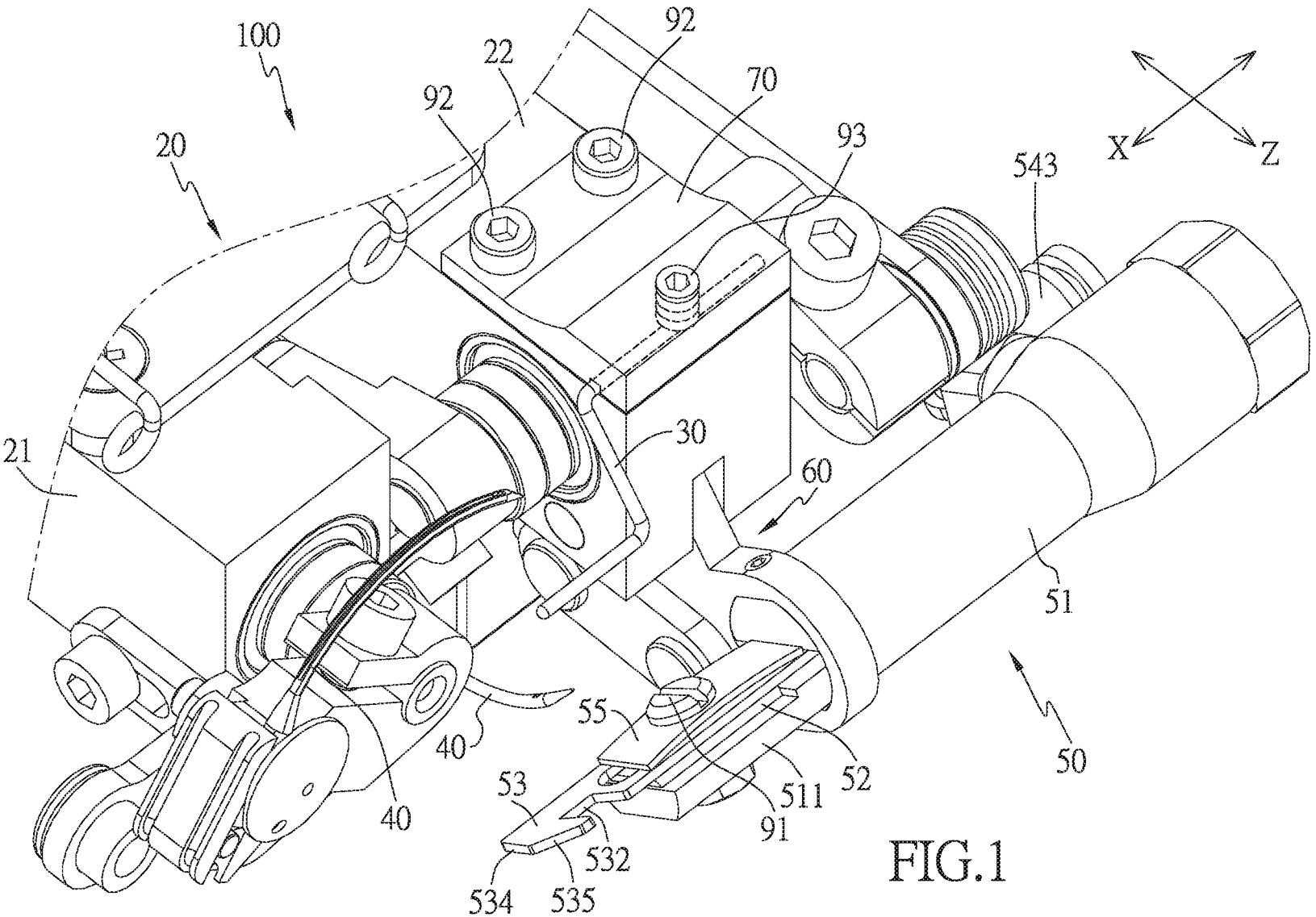
FIG. 1 is a partial perspective view of a sewing or looping device in accordance with the present invention.
Figure 2:
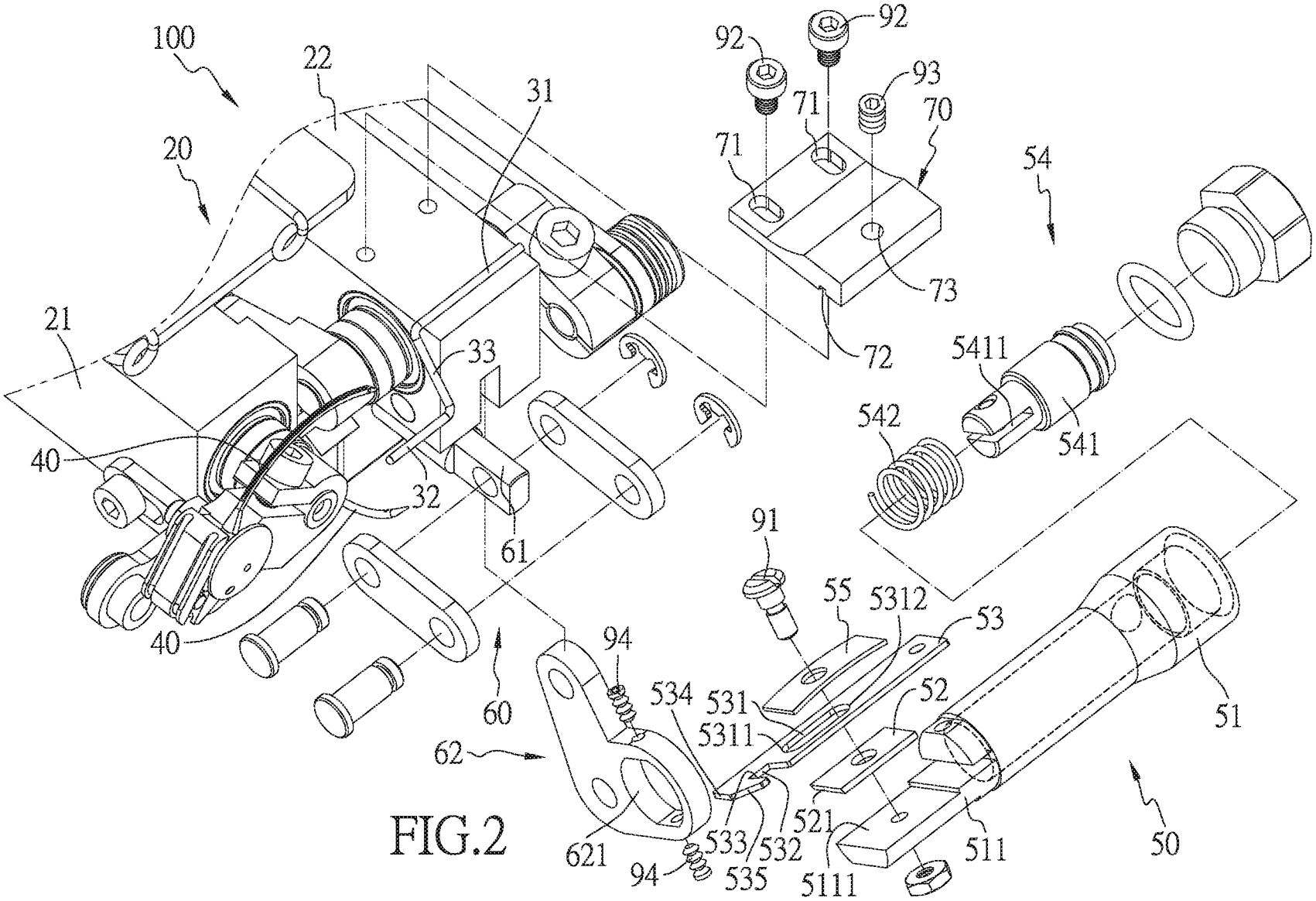
FIG. 2 is an exploded view of the sewing or looping device in accordance with the present invention.

The present invention will be clearer from the following description when viewed together with the accompanying drawings, which show, for purpose of illustrations only, the preferred embodiment in accordance with the present invention.

Referring to FIGS. 1-11, the present invention is a sewing or looping device 100 for closing a tubular knitted article K, and comprises a body 20, a yarn support 30, two needles 40 and a cutting unit 50.

A front side of the body 20 has two bases spaced apart from each other, that is, a first base 21 and a second base 22.

The yarn support 30 has at least one first section 31 and one second section 32. The first section 31 is adjustably disposed on the second base 22, and the second section 32 opposite the first section 31 extends along an axial direction X (shown in FIG. 1).

The two needles 40 are pivotally connected to the first and second bases 21, 22, respectively, and the pivoting movement paths of the two needles 40 are orthogonal to each other and form a sewing chain stitch S at the second section 32. The sewing chain stitch S is formed in a direction away from the first section 31 and is used to sew the tubular knitted article K. The tubular knitted article K can be a sock, but is not limited thereto. The sewing chain stitch S has a first stitch section S1 and a second stitch section S2, the first stitch section S1 is located on the second section 32. In detail, the first stitch section S1 is looped over the second section 32, and the second stitch section S2 is disengaged from the yarn support 30 by moving away from the first section 31. When the two needles 40 are sewing the tubular knitted article K, one tail end S21 of the second stitch section S2 away from the first stitch section S1 is connected to the tubular knitted object K, and the second stitch section S2 is in a tensioned state.

The cutting unit 50 is pivotally connected to the second base 22, and includes a housing 51, a cutting member 52 and a hook member 53. The housing 51 is connected to and driven by a power unit 60 to move toward or away from the body 20 and the yarn support 30. Preferably, the power unit 60 drives the housing 51 to move in an arc path, but not limited thereto. When the power unit 60 drives the housing 51 to move close to the yarn support 30, the cutting unit 50 is in an active position M1, and when the power unit 60 drives the housing 51 away from the yarn support 30, the cutting unit 50 is in a standby position M2. The housing 51 has a cutting arm 511 extending along the axial direction X toward the second base 22. The cutting arm 511 has a fixing surface 5111. When the cutting unit 50 is in the active position M1, the fixing surface 5111 faces the yarn support 30. The cutting member 52 is fixed on the fixing surface 5111, and a side of the cutting member 52 facing away from the housing 51 has a first cutting edge 521. The hook member 53 has a slide slot 531 extending along the axial direction X. The slide slot 531 has a first end 5311 adjacent to the first base 21 and a second end 5312 which is located farther away from the first base 21 than the first end 5311. The hook member 53 is coupled to the cutting arm 511 and abutted against the cutting member 52 by a locking bolt 91 inserted in the slide slot 531, so that the hook member 53 can move back and forth along the direction of the slide hole 531 in the axial direction X. When the first end 5311 is abutted against the locking bolt 91, the hook member 53 is in a withdrawn state P1, and when the second end 5312 is abutted against the locking bolt 91, the hook member 53 is in an out-extended state P2. A hook groove 532 is recessed at one lateral edge of the hook member 53. The hook member 53 further has a second cutting edge 533 facing the hook groove 532. When the hook member 53 is in the out-extended state P2, the second cutting edge 533 faces the first cutting edge 521, and when the hook member 53 is in the withdrawn state P1, the first cutting edge 521 is tangent to the second cutting edge 533 to define a cutting point Q1 which is located away from the tail end S21. A direction in which the hook member 53 moves toward the cutting member 52 is defined as a cutting direction C which is parallel to the direction in which the yarn support 30 extends; in some embodiments, the cutting point Q1 is 3 mm to 15 mm apart from the tail end S21.

The hook member 53 has an end surface 534 and a guiding slope 535, and the end surface 534 extends along the axial direction X. When the cutting unit 50 is in the active position M1, the end surface 534 faces the needles 40 of the first base 21. The guiding slope 535 has one end connected to the end surface 534 and another end connected to the hook groove 532, and is used to guide the sewing chain stitch S into the hook groove 532.

The yarn support 30 further has a connecting portion 33 which has two ends respectively connected with the first section 31 and the second section 32. The first section 31 and the second section 32 respectively extend along the axial direction X and are spaced apart from each other, and an extending direction of the connecting portion 33 is orthogonal to the extending direction of the first and second sections 31, 32, that is, the first section 31 and the second section 32 are parallel to each other and spaced apart from each other, and are not in the same straight line, and the extending direction of the connecting portion 33 is orthogonal (vertical) in the extending direction of the first section 31 and the second section 32.

Figure 3A:
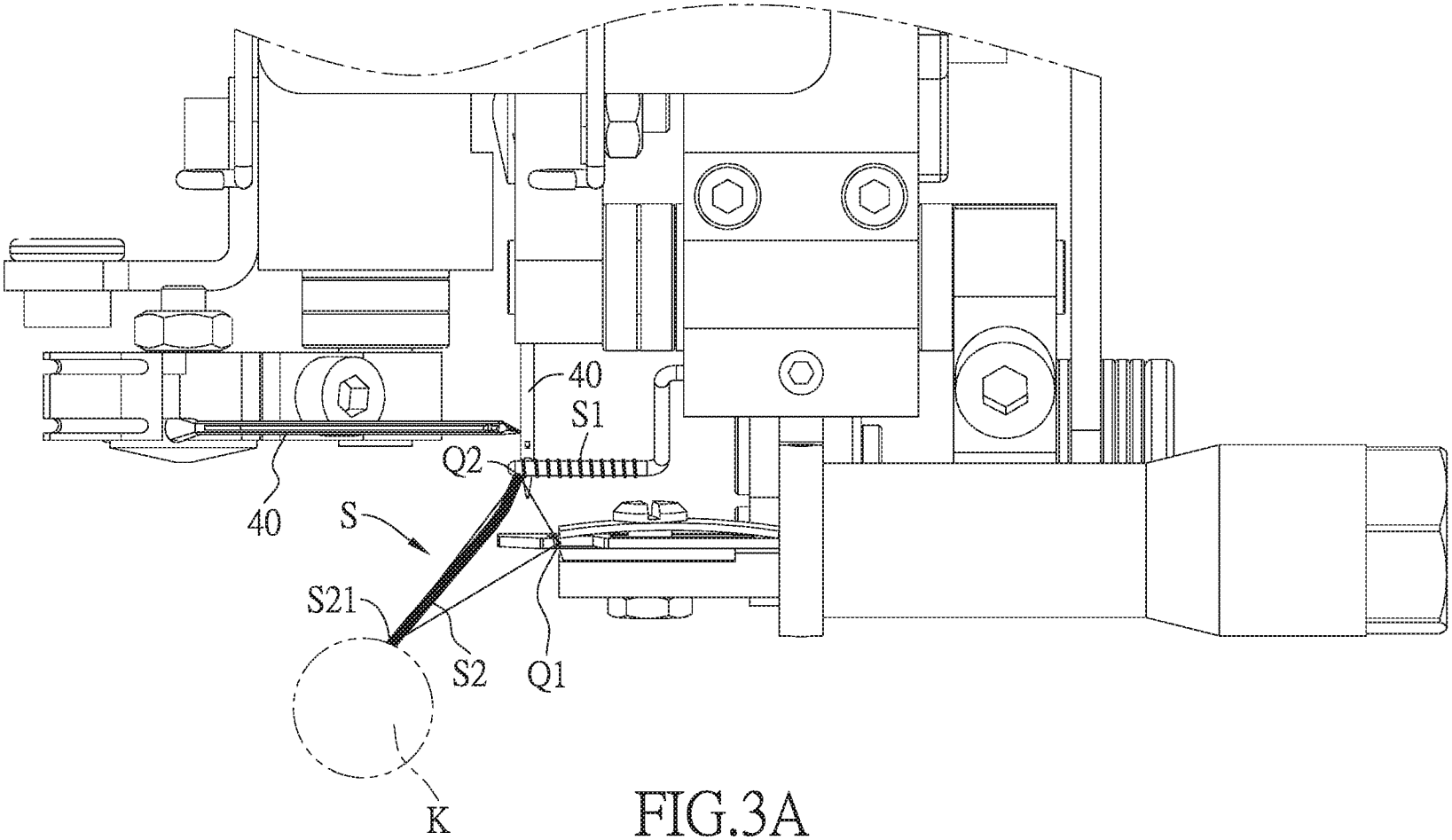
FIG. 3A is a top plan view of the sewing or looping device in accordance with the present invention.

Referring to FIG. 3A, the position where the two needles 40 form the sewing chain stitch S on the second section 32 is defined as a forming point Q2, and the forming point Q2, the tail end S21 and the cutting point Q1 form a triangle. Preferably, the triangle is an obtuse triangle, but is not limited thereto.

Figure 3B:
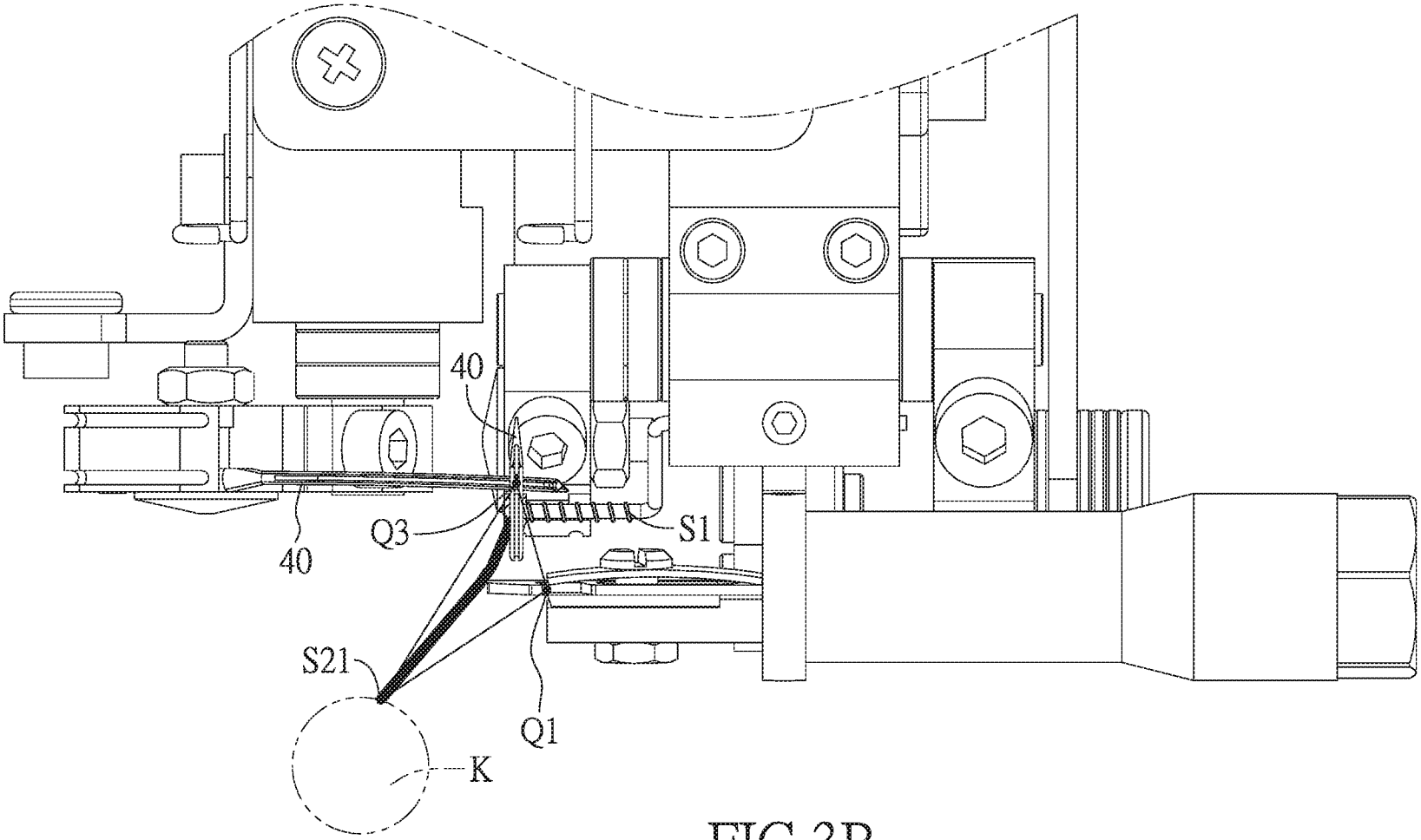
FIG. 3B is a plan view showing another state of the sewing or looping device in accordance with the present invention.
Figure 4:
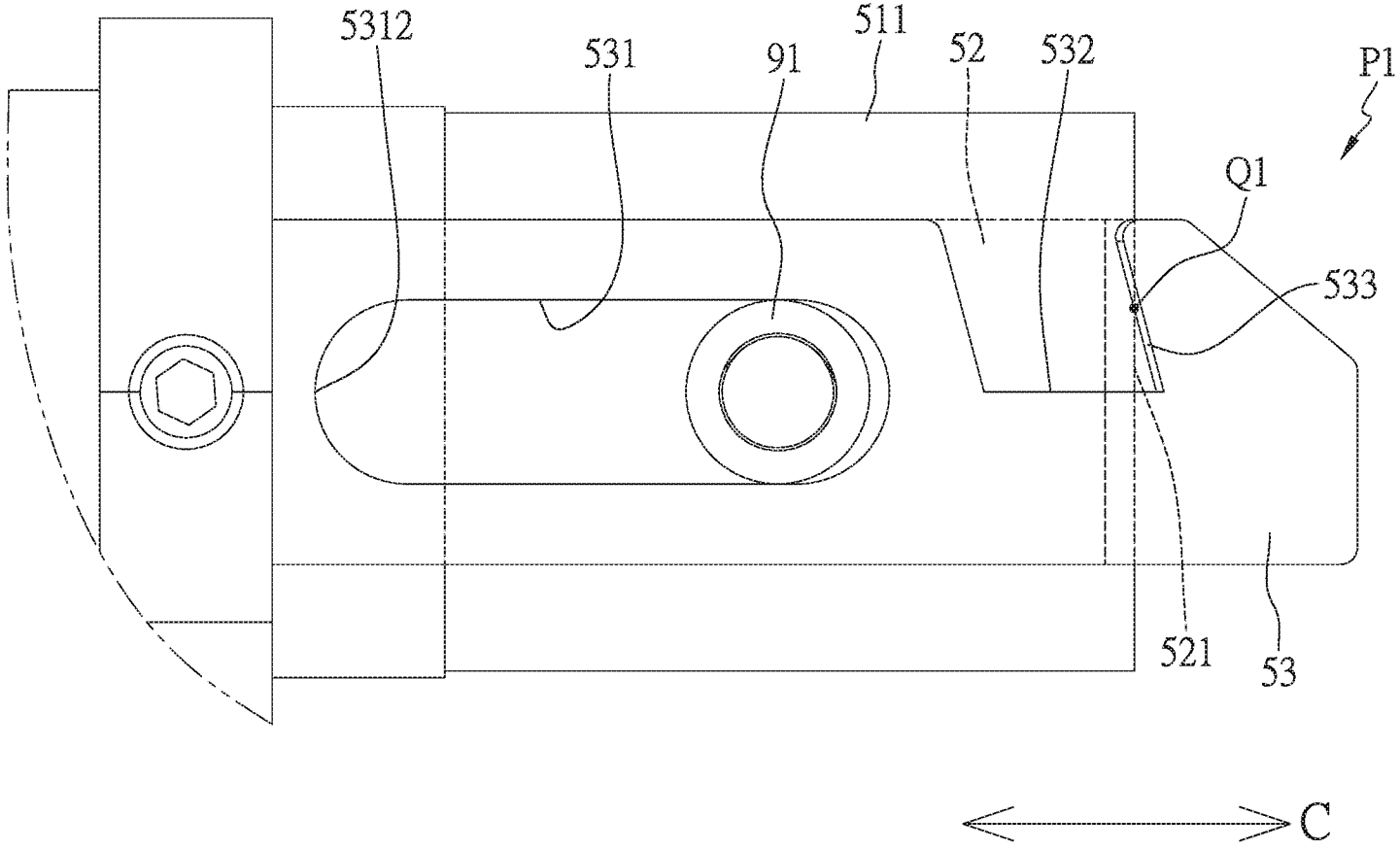
FIG. 4 is a partially magnified view showing the cutting point jointly defined by the hook member and the cutting member of the sewing or looping device in accordance with the present invention.
Figure 5:
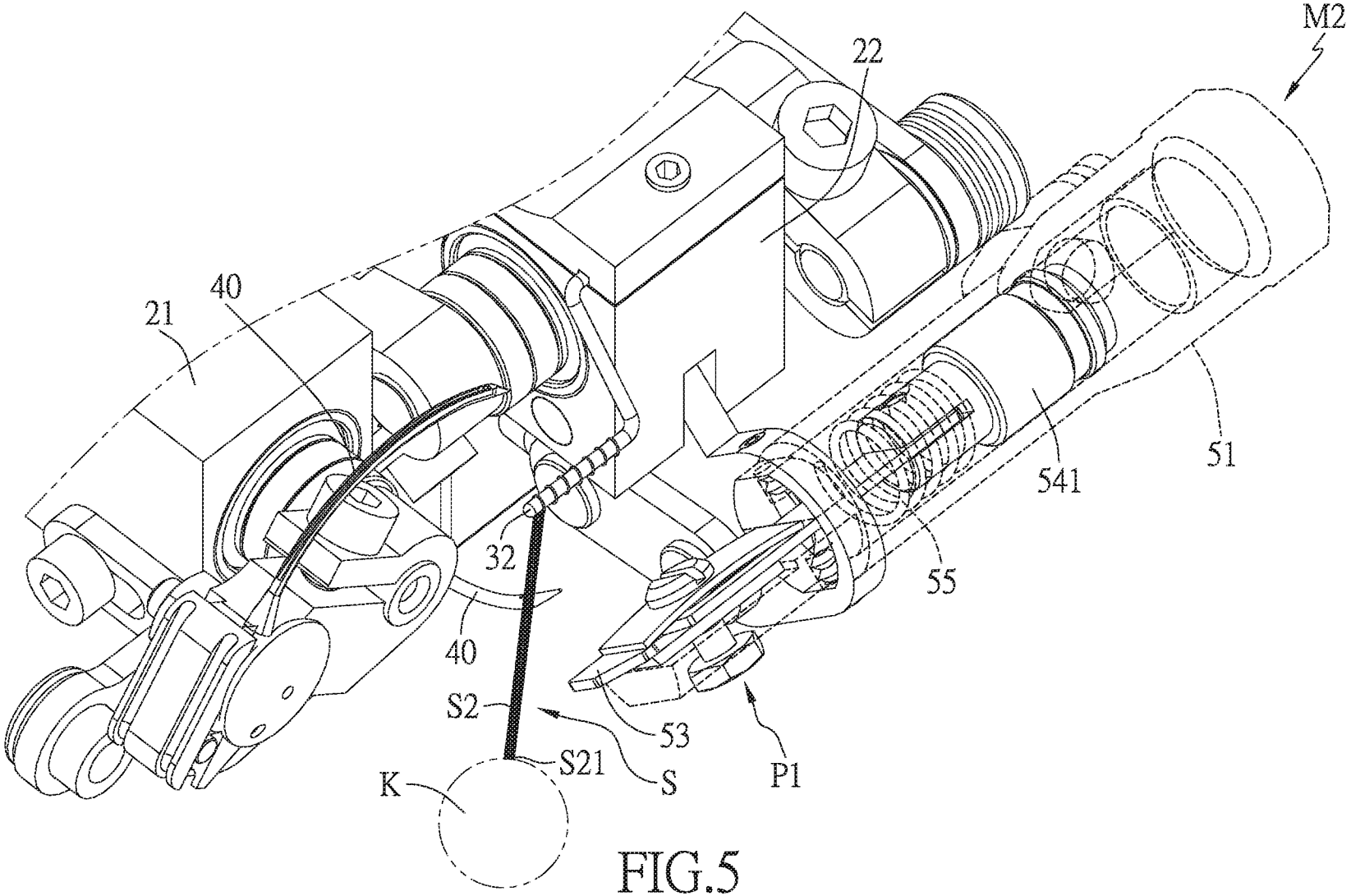
FIG. 5 is a perspective view of the cutting unit of the sewing or looping device in accordance with the present invention is in the standby position.
Figure 6:
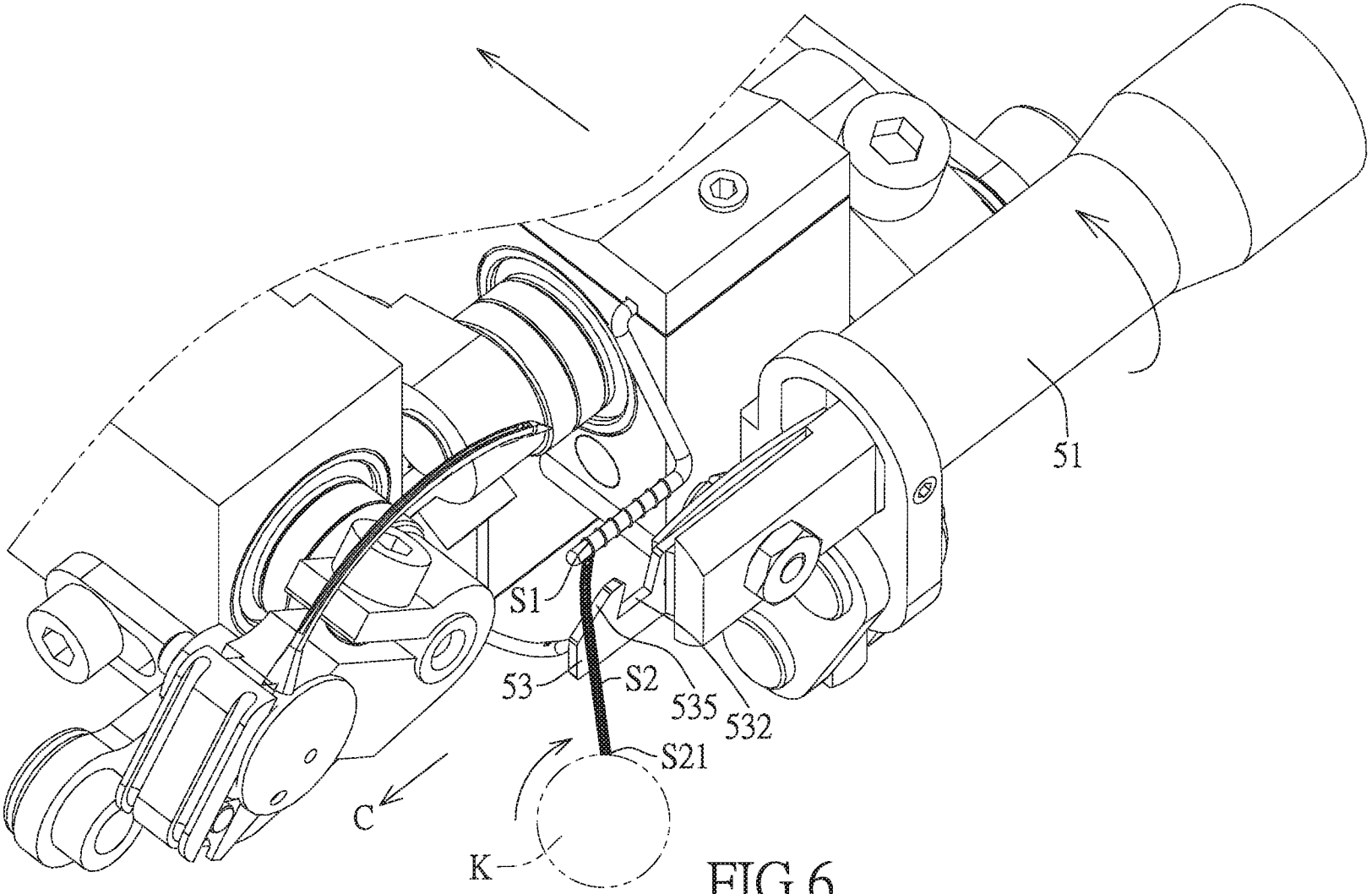
FIG. 6 is a perspective view of the sewing or looping device in accordance with the present invention showing the cutting unit is in the active position and the hook is extended out, so that the sewing chain suture is guided by the guiding slope.
Figure 7:
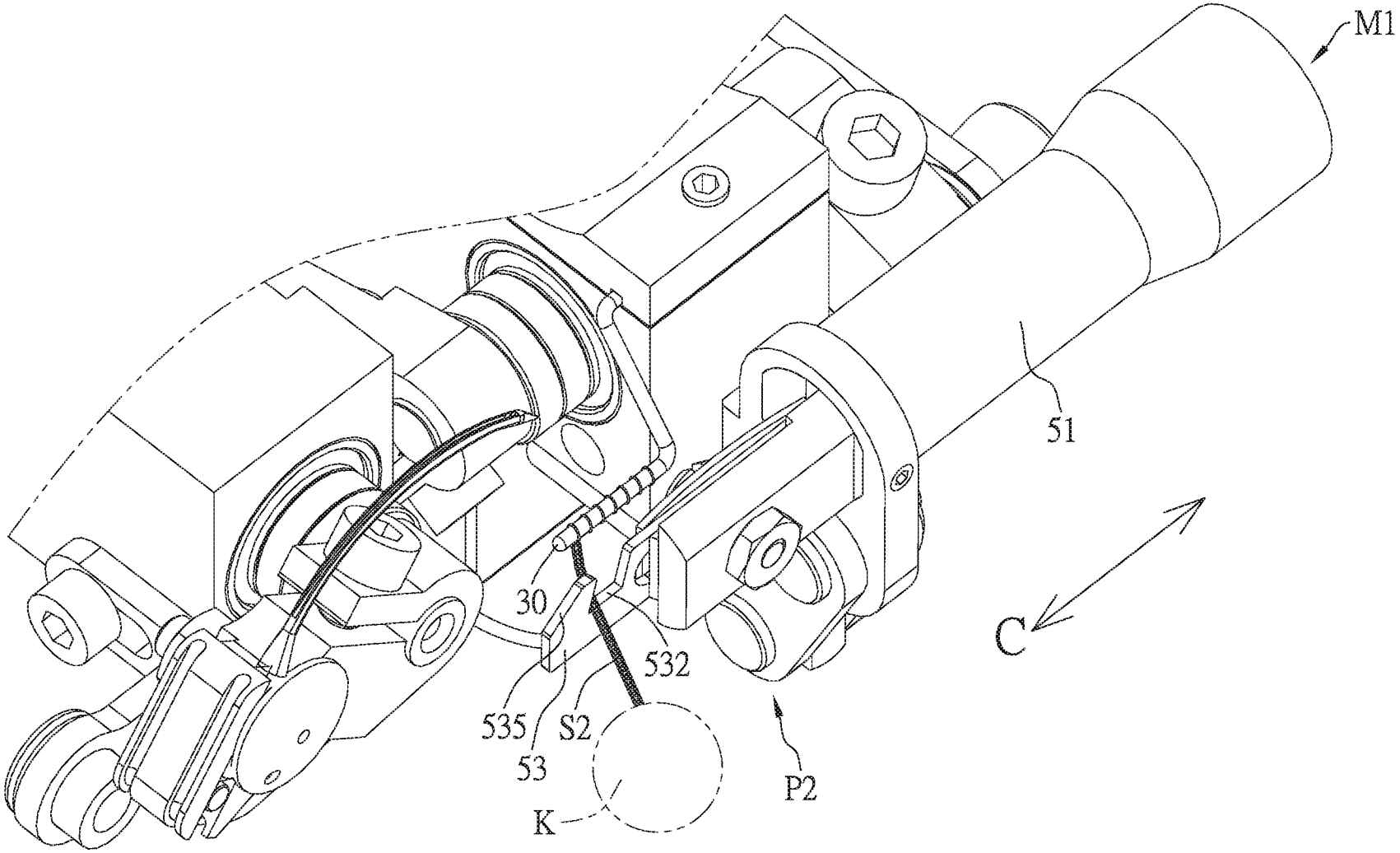
FIG. 7 is a perspective view showing that the cutting unit of the present invention in a state in which the hook member is in an out-extended position and the chain suture is dropped into the hook groove.
Figure 8:
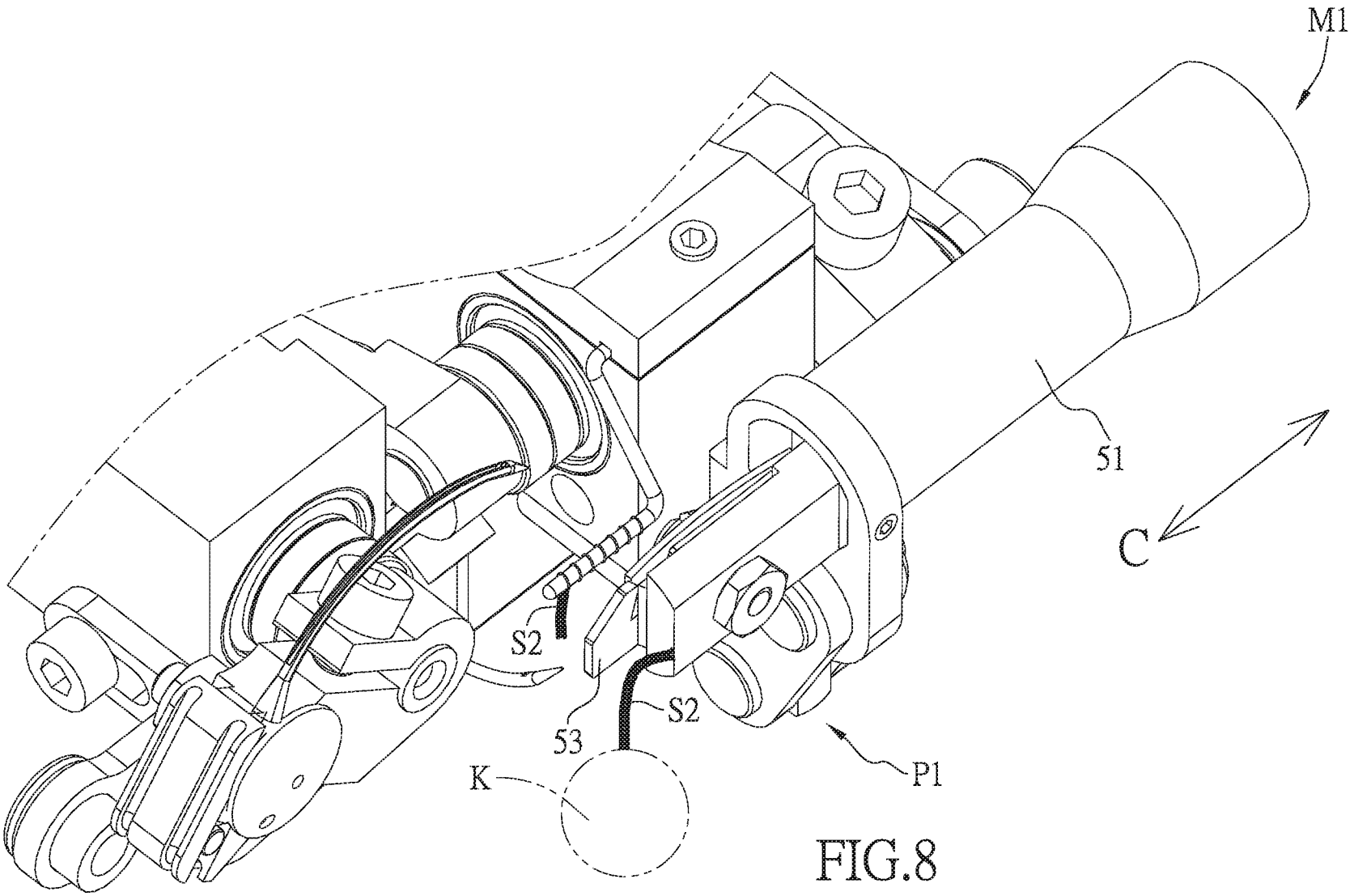
FIG. 8 is a perspective view of the invention showing that the hook member pulls the sewing chain stitch to the cutting point.

Referring to FIG. 3B, the intersection of the pivoting movement paths of the two needles 40 is defined as an intersection point Q3, and the intersection point Q3, the tail end S21 and the cutting point Q1 together form a triangle. Preferably, the triangle is an obtuse triangle, but not limited to this.

The second base 22 is provided with an upper cover 70. The upper cover 70 defines an adjustment hole 71, an elongated groove 72 and a pressing hole 73. The adjustment hole 71 is an elongated slot extending along an adjustment direction Z (shown in FIG. 1) which intersects with the axial direction X (as shown in FIG. 1), and the adjustment hole 71 has two opposite ends which are close to and away from the cutting unit 50. A fixing bolt 92 is inserted through the adjustment hole 71 and fixed to the second base 22. The elongated groove 72 is formed in a surface of the upper cover 70 facing the first base 21, and the longitudinal cross section of the elongated groove 72 is substantially rectangular. The first section 31 extends into the elongated groove 72, a pressing bolt 93 is inserted through the pressing hole 73 to press against the first section 31. That is, the rectangular longitudinal cross section of the elongated groove 72 and the circular circumference of the first section 31 are tightly pressed against each other, thereby preventing the first section 31 from rotating and sliding.

The power unit 60 has a driving rod 61 repeatedly displaced along the adjustment direction Z, and a limiting block 62 pivotally connected to the second base 22 and the driving rod 61. The limiting block 62 has a locking hole 621 for insertion and locking of the housing 51, and the two locking pins 94 are inserted through the limiting block 62 and the housing 51 and into the housing 51. A driving member 54 is disposed in the housing 51 and can be a pneumatic driving member (for example, a pneumatic cylinder). The driving member 54 has a base 541 and an elastic member 542. The base 541 is disposed in the housing 51 and has a locking slot 5411 facing the cutting member 52. One end of the hook member 53 opposite the hook groove 532 is locked and fixed in the locking slot 5411, and the elastic member 542 has one end abutted against the two locking pins 94, and another end fixed on the base 541. An air pipe 543 is further disposed on the housing 51 to communicate with the inside of the housing 51, with the air pipe 543 inputting and outputting air in and out of the space inside the housing 51, the base 541 inside the housing 51 can be pushed to slide repeatedly inside the housing 51 along the axial direction X.

Finally, an elastic piece 55 is disposed on one surface of the hook member 53, so that the hook member 53 is clamped between the elastic piece 55 and the cutting member 52. The cutting arm 511, the cutting member 52, the hook member 53 and the elastic piece 55 are assembled together by the locking bolt 91 inserting them through. Then, the hook member 53 is pressed against the cutting member 52 by the elastic piece 55, so that the first cutting edge 521 and the second cutting edge 533 are surely joined to form the cutting point Q1 to effectively cut the sewing chain stitch S.

Figure 12:
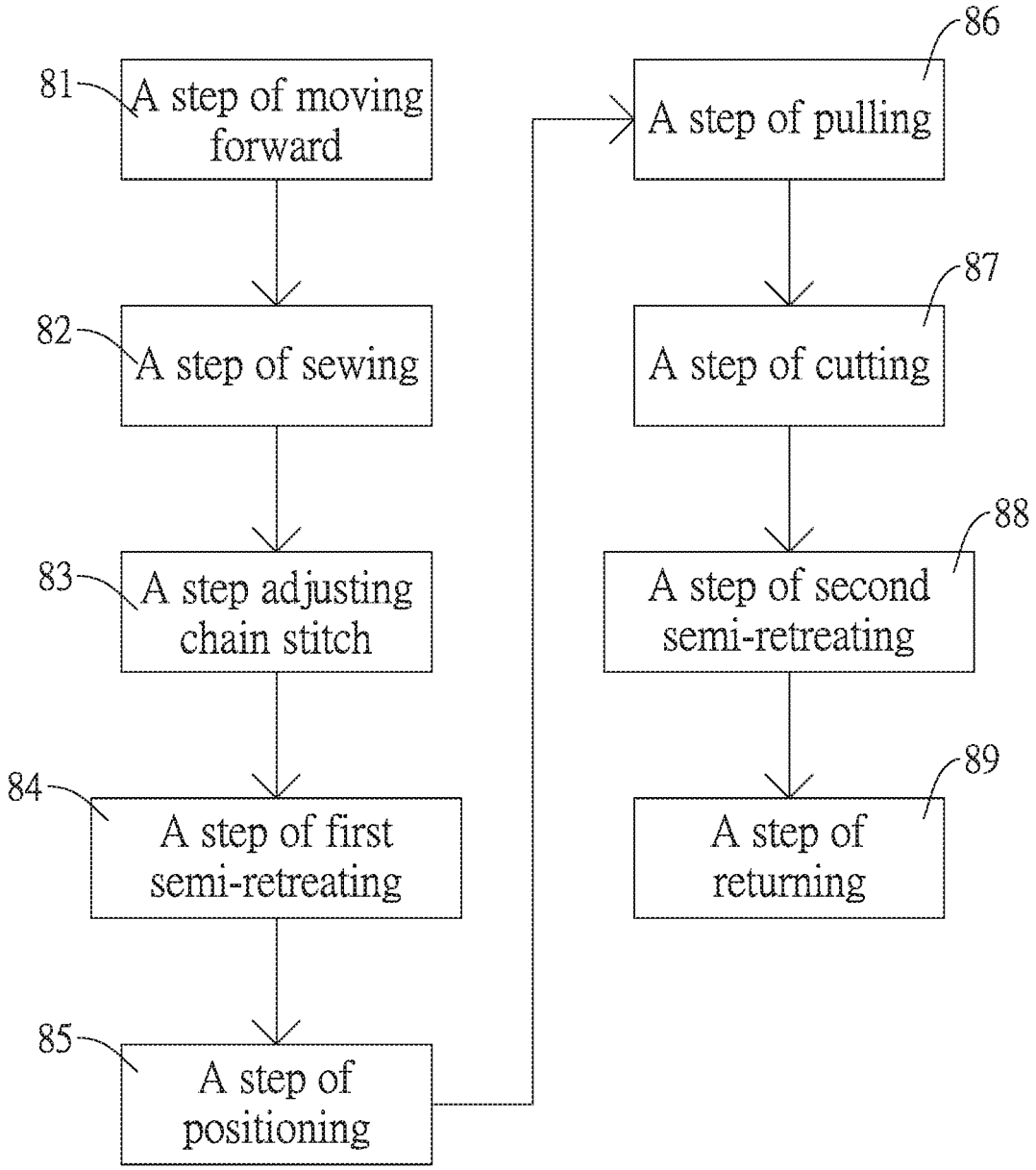
FIG. 12 is a flow chart showing the steps of using the sewing or looping device in accordance with the present invention.

Please refer to FIG. 12, the method of using the sewing or looping device to close a tubular knitted article mentioned above comprising the following steps:

A step 81 of moving forward: moving the body 20 toward the tubular knitted article K by a forward distance to a position where the tubular knitted article K can be processed.

A step 82 of sewing: pivotally moving the two needles 40 to sew the tubular knitted article K, with the cutting unit 50 staying in the standby position M2, and the hook member 53 in the withdrawn state P1.

A step 83 adjusting chain stitch: rotating the tubular knitted article K such that the second section 32 of the sewing chain stitch S connected to the tubular knitted article K is in a relaxed state.

A step 84 of first semi-retreating: moving the body 20 in a direction away from the tubular knitted article K by a first half of a retreat distance, and the first half of the retreat distance is less than the forward distance, at this time, the second section 32 of the sewing chain stitch S is in a tensioned state.

A step 85 of positioning: moving the cutting unit 50 from the standby position M2 to the active position M1, inputting air, by the air pipe 543, into the housing 51 to cause the hook member 53 to slide out of the housing 51 along the axial direction X, during the sliding out, the sewing chain stitch S slides along the guiding slope 535 into the hook groove 532.

A step 86 of pulling: outputting air by the air pipe 543, pushing the base 541 by the elastic member 542 to drive the hook member 53 to slide toward an inside of the housing 51, so that the cutting unit 50 pulls the sewing chain stitch S to the cutting point Q1, and causing the second stitch section S2 of the sewing chain stitch S to continue to assume a tensioned state.

A step 87 of cutting: moving the hook member 53 continuously toward the inside of the housing 51, and pulling, by the hook member 53, the sewing chain stitch S to the cutting point Q1 to cut the sewing chain stitch.

A step 88 of second semi-retreating: moving the body 20 in the direction away from the tubular knitted article K by a second half of the retreat distance, and a sum of the first half of the retreat distance and the second half of the retreat distance is equal to the forward distance.

A step 89 of returning: moving the cutting unit 50 back from the active position M1 to the standby position M2.

Figure 9:
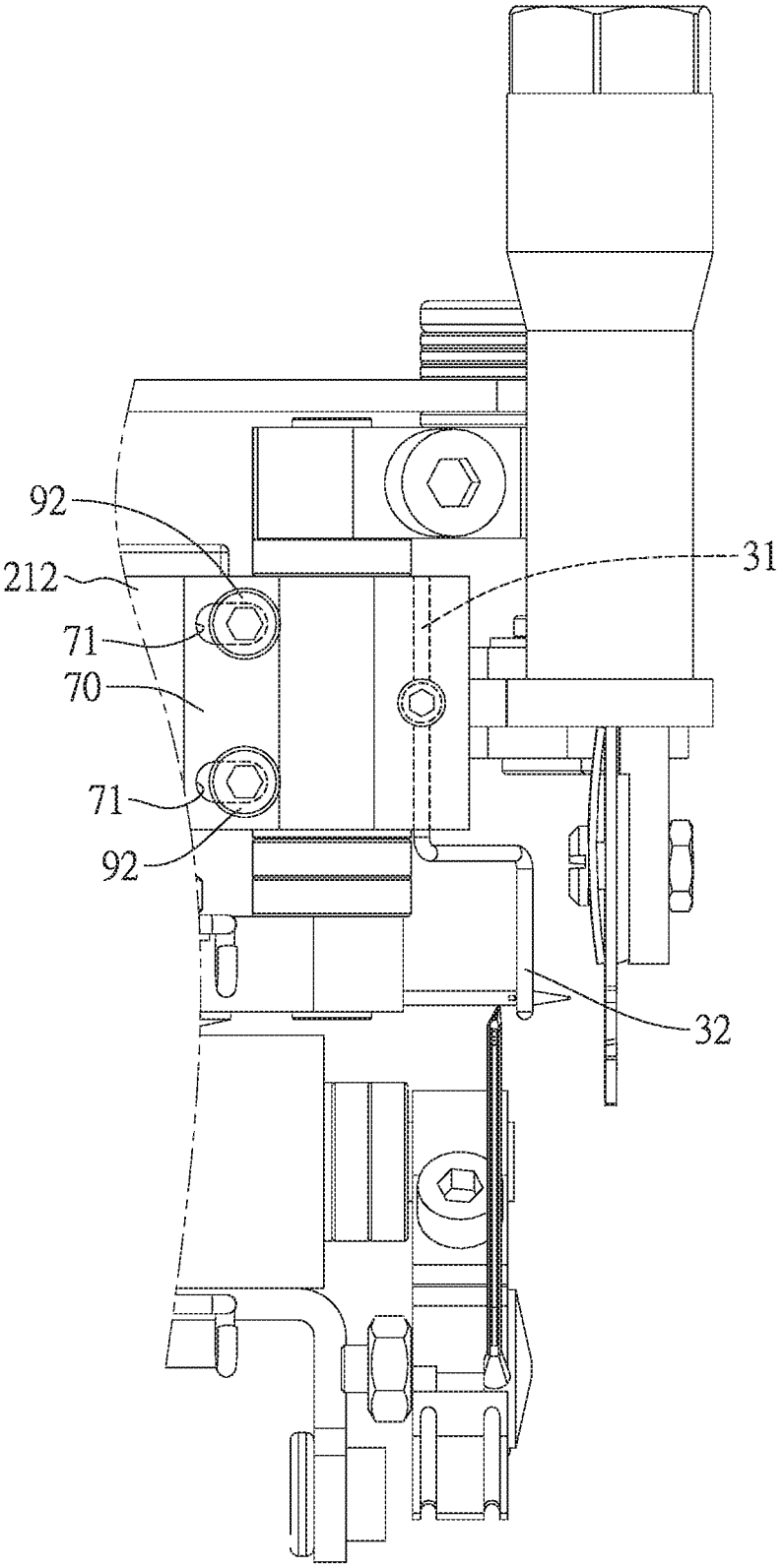
FIG. 9 is a plan view of the invention showing that the cover is in the first position.
Figure 10:
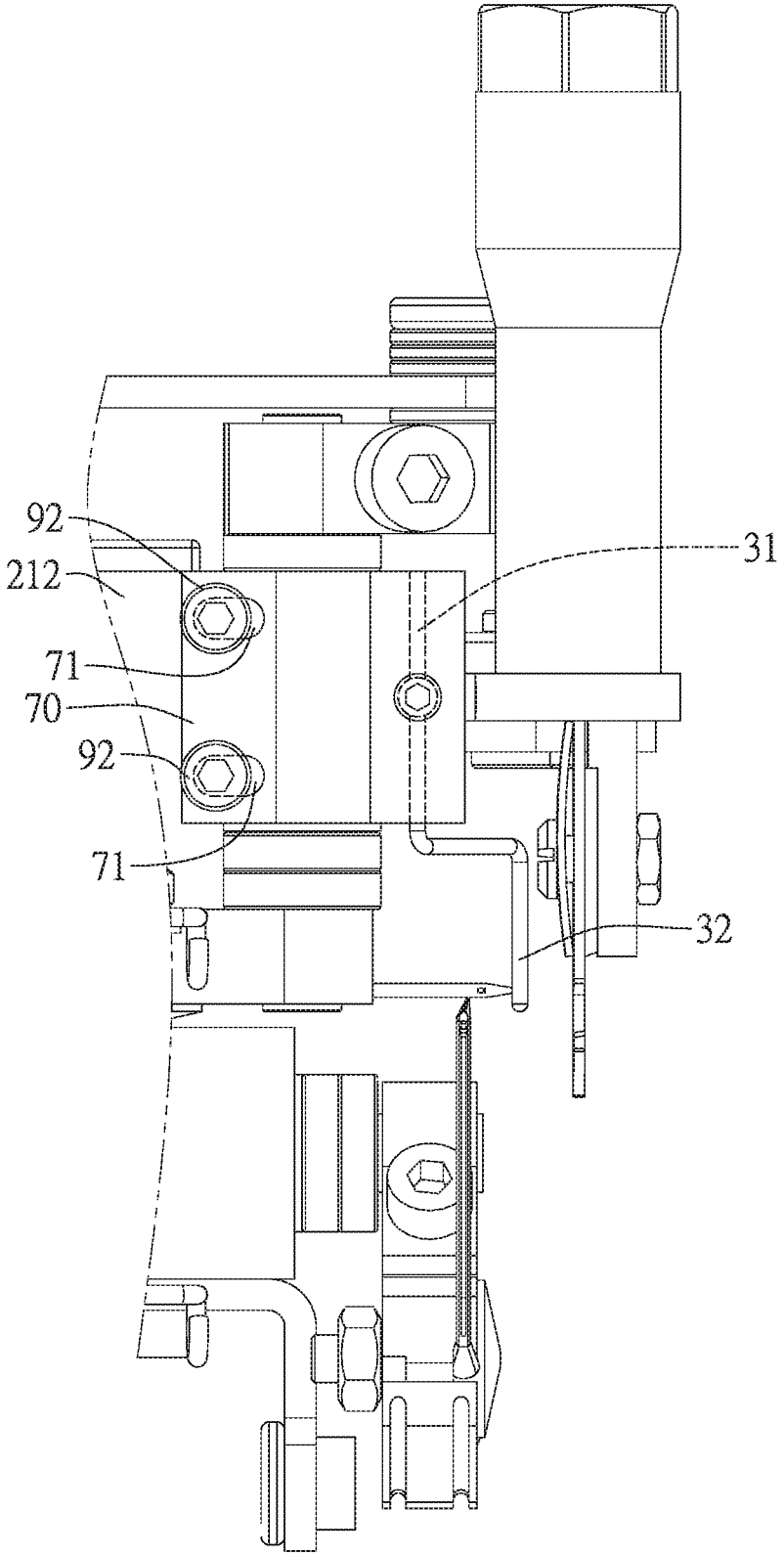
FIG. 10 is a plan view of the invention showing that the cover is in the second position.

Referring to FIGS. 9 and 10, when the user wants to adjust the distance between the yarn support 30 and the cutting unit 50, the fixing bolt 92 can be released first, and then the upper cover 70 can be moved along the adjustment direction Z to move close to or away from the cutting unit 50, and the yarn support 30 is approached or away from the cutting unit 50 along with the upper cover 70. After the adjustment is completed, the user then locks the fixing bolt 92 to fix the upper cover 70 to accommodate the stitching and cutting of tubular knitted articles K of different diameters.

Figure 11:
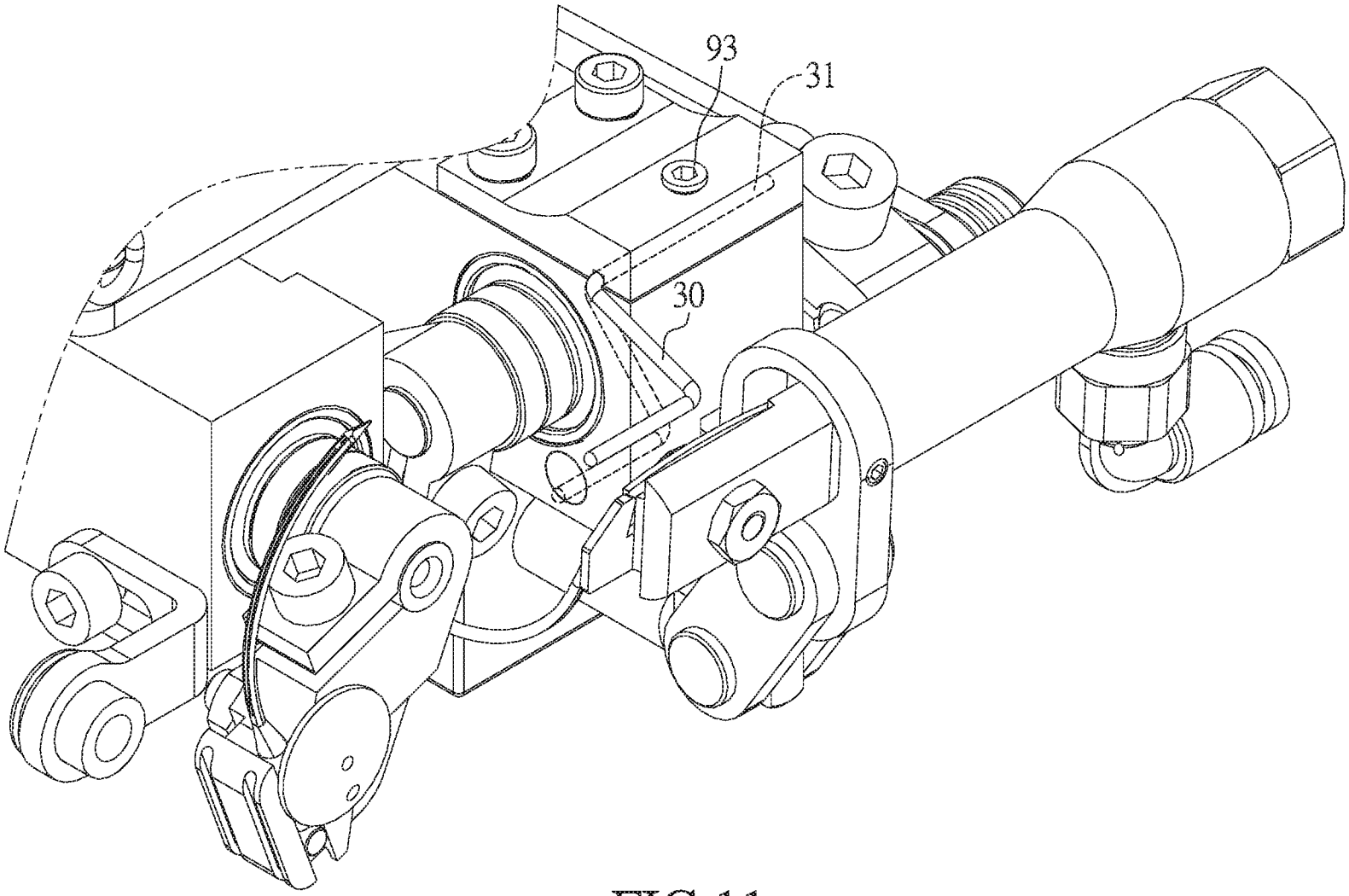
FIG. 11 is a schematic view of the invention showing the rotation of the yarn support.

Referring to FIG. 11, when the yarns or stitches of different materials are used and the angle of the yarn support 30 needs to be adjusted accordingly, the pressing bolt 93 can be released first, so that the yarn support 30 can be rotated around the axis of the first section 31 to adjust the angle of the yarn support 30. After the adjustment is completed, the user then tightens the pressing bolt 93 to fix the yarn support 30, thereby adapting the stitches of different materials and adjusting the tightness of the yarns.

When the present invention is cutting the sewing chain stitch S, the sewing chain stitch S can be pulled to the cutting point Q1 by the hook member 53 and cut thereat. When the hook member 53 pulls the sewing chain stitch S, the sewing chain stitch S assumes a tensioned state, which in turn allows the sewing chain stitch S to be cut more reliably and more easily.

More preferably, the sewing or looping device of the present invention performs cutting by hooking the sewing chain stitch S by the hook member 53, and can be set on one side of the body 20, and then hooking the sewing chain stitch S to the cutting point Q1. The body 20 does not have to preserve a space for the sewing or looping device, thereby achieving the effect of reducing the volume of the body 20.

Finally, the cutting unit 50 and the yarn support 30 are both disposed on the second base 22, and the direction in which the hook member 53 pulls the sewing chain stitch S is opposite to the direction in which the sewing chain stitch S is disengaged from the yarn support 30. Therefore, the sewing chain stitch S does not come off the yarn support 30 when being pulled, which in turn prevents the sewing chain stitch S from coming off the yarn support 30.

While we have shown and described various embodiments in accordance with the present invention, it is clear to those skilled in the art that further embodiments may be made without departing from the scope of the present invention.

What is claimed is:

1. A sewing or looping device for closing a tubular knitted article, comprising a body, two needles, a yarn support, and a cutting unit; a front side of the body having two bases spaced apart from each other, the two needles being pivotally connected to the two bases, respectively, and pivoting movement paths of the two needles are orthogonal to each other, the yarn support having a first section adjustably disposed on one of the bases, and a second section of the yarn support opposite the first section extends along an axial direction, the cutting unit being pivotally connected to the one of the bases where the yarn support is located, characterized in that:

a cutting direction of the cutting unit is parallel to the axial direction of the yarn support;

the two bases include a first base and a second base, the cutting unit is pivotally connected to the second base, and includes a housing, a cutting member and a hook member, the housing is connected to a power unit and has a cutting arm extending along the axial direction toward the second base, the cutting arm has a fixing surface, the cutting member is fixed on the fixing surface, and a side of the cutting member facing away from the housing has a first cutting edge, a hook groove is recessed at one lateral edge of the hook member, the hook member has a second cutting edge facing the hook groove and further has a slide slot extending along the axial direction, the slide slot has a first end adjacent to the first base and a second end which is located farther away from the first base than the first end, the hook member is coupled to the cutting arm and abutted against the cutting member by a locking bolt inserted in the slide slot, when the first end is abutted against the locking bolt, the hook member is in a withdrawn state, and when the second end is abutted against the locking bolt, the hook member is in an out-extended state, when the hook member is in the out-extended state, the second cutting edge faces the first cutting edge, and when the hook member is in the withdrawn state, the first cutting edge is tangent to the second cutting edge to define a cutting point, the hook member has an end surface and a guiding slope, when the cutting unit is in an active position, the end surface faces the needle of the first base, and the guiding slope has one end connected to the end surface and another end connected to the hook groove.

2. The sewing or looping device for closing the tubular knitted article as claimed in claim 1, wherein the pivoting movement paths of the two needles are orthogonal to each other to form a sewing chain stitch at the second section to sew the tubular knitted article, the sewing chain stitch is formed in a direction away from the first section and has a first stitch section and a second stitch section, the first stitch section is located on the second section, the first stitch section is looped over the second section, the second stitch section is disengaged from the second section of the yarn support, the second stitch section has one end connected to the first stitch section, and another end of the second stitch section opposite to the one end connected to the first stitch is a tail end which is connected to the tubular knitted article to sew the tubular knitted article and adjust the second stitch section to a tensioned state, the cutting unit pulls the second stitch section of the sewing chain stitch that has been adjusted to the tensioned state to a cutting point to perform cutting, the cutting point is located away from the tail end of the second stitch section, the yarn support further has a connecting portion which has two ends respectively connected with the first section and the second section, the first section and the second section are parallel to each other and spaced apart from each other, and an extending direction of the connecting portion is orthogonal in an extending direction of the first section and the second section.

3. The sewing or looping device for closing the tubular knitted article as claimed in claim 1, wherein the cutting point is located away from a tail end of a sewing chain stitch, the pivoting movement paths of the two needles are orthogonal to each other to form the sewing chain stitch at the second section, a forming point of the sewing chain stitch, the tail end and the cutting point form a triangle.

4. The sewing or looping device for closing the tubular knitted article as claimed in claim 1, wherein the cutting point is located away from a tail end of a sewing chain stitch, the pivoting movement paths of the two needles are intersected at an intersection point, and the intersection point, the tail end and the cutting point together form a triangle.

5. A method of using the sewing or looping device for closing the tubular knitted article as claimed in claim 1, comprising the following steps: a step of pulling: pulling, by the cutting unit, a sewing chain stitch to the cutting point which is located away from one end of the second section of the yarn support; and a step of cutting: cutting the sewing chain stitch at the cutting point, wherein a step of positioning is performed before the step of pulling, and includes: moving the cutting unit from a standby position to the active position; a step of sewing is carried out before the step of positioning and includes: pivotally moving the two needles to sew the tubular knitted article, with the cutting unit staying in the standby position, the pivoting movement paths of the two needles are orthogonal to each other to form the sewing chain stitch at the second section the sewing chain stitch is formed in a direction away from the first section and has a first stitch section and a second stitch section, the first stitch section is located on the second section, the first stitch section is looped over the second section, the second stitch section is disengaged from the second section of the yarn support, the second stitch section has one end connected to the first stitch section, another end of the second stitch section opposite to the first end connected to the first stitch section is a tail end, and when the tail end is connected to the tubular knitted article to sew the tubular knitted article, the cutting unit is in the standby position; a step of moving forward is carried out before the step of sewing and includes: moving the body toward the tubular knitted article by a forward distance; and a step of returning is carried out after the step of cutting and includes moving the cutting unit back from the active position to the standby position; a step of first semi-retreating is performed between the step of sewing and the step of positioning and includes: moving the body in a direction away from the tubular knitted article by a first half of a retreat distance, and the first half of the retreat distance is less than the forward distance, the second section of the sewing chain stitch is in a tensioned state after the step of first semi-retreating; a step of adjusting chain stitch is carried out between the step of sewing and the step of first semi-retreating and includes: rotating the tubular knitted article such that the second section of the sewing chain stitch connected to the tubular knitted article is in a relaxed state; and a step of second semi-retreating is carried out after the step of cutting and includes: moving the body in the direction away from the tubular knitted article by a second half of the retreat distance, and a sum of the first half of the retreat distance and the second half of the retreat distance is equal to the forward distance.

* * * * *